US005995055A

United States Patent [19]

Milroy

[11] Patent Number: 5,995,055

[45] Date of Patent: Nov. 30, 1999

[54] PLANAR ANTENNA RADIATING STRUCTURE HAVING QUASI-SCAN, FREQUENCY-INDEPENDENT DRIVING-POINT IMPEDANCE

[75] Inventor: William W. Milroy, Playa del Rey, Calif.

[73] Assignee: Raytheon Company, Lexington, Mass.

[21] Appl. No.: 08/885,583

[22] Filed: Jun. 30, 1997

[51] Int. Cl.[6] ..... H01Q 13/00; H01Q 13/10

[52] U.S. Cl. ..... 343/772; 343/767; 343/771

[58] Field of Search ..... 343/771, 770, 343/767, 785, 700 MS, 772

[56] References Cited

U.S. PATENT DOCUMENTS 5,483,248 1/1996 Milroy ..... 343/767

*Primary Examiner*—Don Wong

*Assistant Examiner*—Hoang Nguyen

*Attorney, Agent, or Firm*—Leonard A. Alkov; Glenn H. Lenzen, Jr.

[57] ABSTRACT

A planar antenna radiating structure comprising an array of continuous transverse stubs having a stepped configuration arranged in a ground plane of a parallel-plate waveguide. Control of the complex reflection coefficient of the aperture of the radiating structure over a range of operating frequencies and scan angles is accomplished using parallel-plate waveguide modes through a choice of stub length(s), stub height(s), inter-stub spacings, parallel-plate separation and the properties of dielectric media used for the parallel-plate waveguide and stubs.

5 Claims, 2 Drawing Sheets

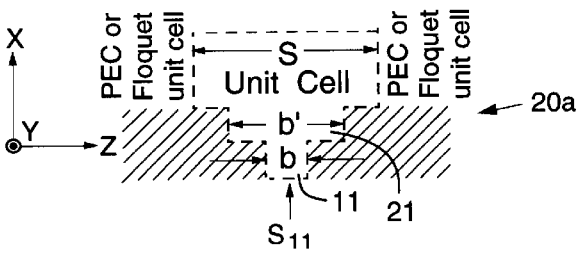
FIG. 4a
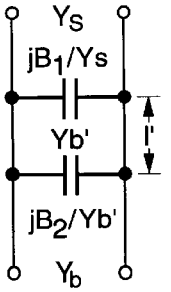
FIG. 4b
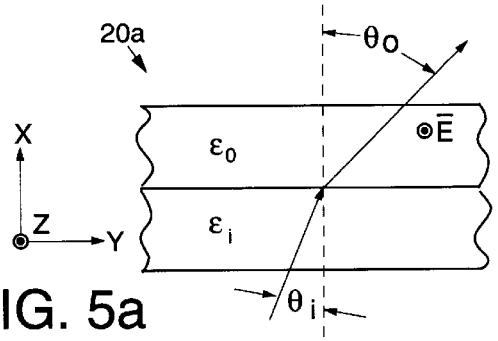
FIG. 5a
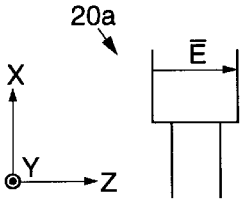
FIG. 5b
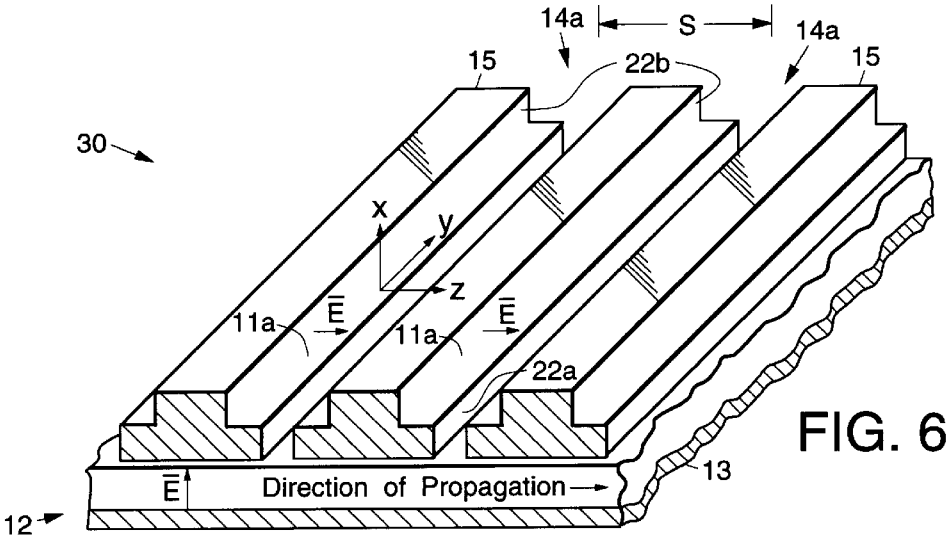
FIG. 6
FIG. 7
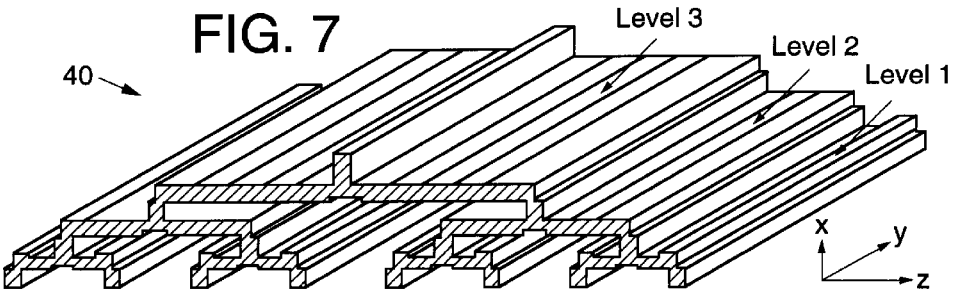

PLANAR ANTENNA RADIATING STRUCTURE HAVING QUASI-SCAN, FREQUENCY-INDEPENDENT DRIVING-POINT IMPEDANCE

BACKGROUND

The present invention relates generally to planar antennas, and more particularly, to a planar antenna radiating structure having a quasi-scan, frequency-independent driving-point impedance.

Examples of planar radiating elements include printed patches and slot radiators. Recent innovations in patch arrays have resulted in significant increases in operating bandwidth. However, broadband patch designs are typically limited to only about twenty to thirty percent bandwidth. Further, the circuit losses of patch arrays seriously limit their efficiency, especially in electrically large arrays and/or arrays operating at millimeter-wave frequencies. Slotted waveguide arrays are planar and have low losses. However, the operating bandwidth is typically limited to less than fifteen percent.

Both types of radiators are essentially resonant structures, exhibiting typical "high-Q" characteristics which limit their ultimate frequency bandwidth due to significant reactive components. In addition, both structures exhibit strong scan-dependent driving-point impedance characteristics due to strong, ill-behaved mutual coupling and potential surface-wave phenomena.

Accordingly, it is an objective of the present invention to provide for an improved planar antenna radiating structure having a quasi-scan, frequency-independent driving-point impedance.

SUMMARY OF THE INVENTION

To meet the above and other objectives, the present invention provides for a multi-stage planar antenna radiating structure comprising an array of continuous transverse stubs having a stepped configuration arranged in conducting ground plane(s) of a parallel-plate waveguide to form a planar antenna radiating structure of arbitrary size. Precise control of the complex reflection coefficient of the aperture over a range of operating frequencies and scan angles is through appropriate selection of stub length(s), stub height (s), inter-stub spacing parallel-plate separation and the properties of the dielectric media used for the parallel-plate waveguide and stubs. The driving point, or input impedance of the array, is made to be nearly constant and real (nonreactive) over a wide range of frequencies by using broadband matching techniques to compensate for the intrinsic capacitive reactance of the stub/free-space interface. The intrinsic capacitive susceptance of a stub/free-space interface is discussed found in Marcuvitz, N. (ed.), "Waveguide Handbook", MIT Radiation Lab. Ser. No. 10, pp. 183–186, McGraw-Hill, New York, 1951.

The present invention provides for a planar radiating structure with frequency-independent driving-point impedance, which facilitates the realization of compact, true-time-delay antenna apertures for fixed, one-dimensional, and two-dimensional electronically-scanned arrays. The continuous transverse stub radiators are implemented in the parallel-plate waveguide, a low-loss TEM transmission line that is nondispersive. Alternatively, the continuous transverse stub radiators may be constructed in an overmoded rectangular waveguide ($Te_{m,0}$ modes), which normally operates far from cutoff where it is practically nondispersive. The continuous transverse stub radiators may also be used to produce shaped beams, multiple beams, and may operate in dual-polarization modes and multiple frequency bands. Key advantages of the present invention include a robust design methodology for low-cost production, ultrawide instantaneous bandwidth, low dissipative losses and direct, well-behaved, continuous H-plane and discrete E-plane scan capability.

The continuous transverse stub planar antenna radiating structure of the present invention may be used to provide a true time delay continuous transverse stub array antenna. The present continuous transverse stub planar antenna radiating structure was reduced to practice and configured to operate over an operating band from 5.0 to 20.0 GHz.

The present invention may be used in multifunctional military systems or high-production commercial products where a single ultra-wideband aperture replaces several narrowband antennas, such as in a point-to-point digital radio, or global broadcast satellites (GBS). Also, the cross section of the present invention is invariant in one dimension, and it may be made using inexpensive, high-volume fabrication techniques such as extrusion processes or plastic injection molding processes.

BRIEF DESCRIPTION OF THE DRAWINGS

The various features and advantages of the present invention may be more readily understood with reference to the following detailed description taken in conjunction with the accompanying drawings, wherein like reference numerals represent like structural elements, and in which:

FIG. 4*a* illustrates a unit cell of a matched continuous transverse stub radiator;

FIG. 4*b* illustrates an equivalent circuit of the unit cell of FIG. 4*;*

FIGS. 5*a* and 5*b* illustrate beam scanning using the continuous transverse stub radiator 11;

FIG. 6 illustrates an antenna radiating structure in accordance with the principles of the present invention; and FIG. 7 illustrates a true-time-delay (corporate) feed structure that may be alternatively used to feed the present invention.

DETAILED DESCRIPTION

Figure 1:
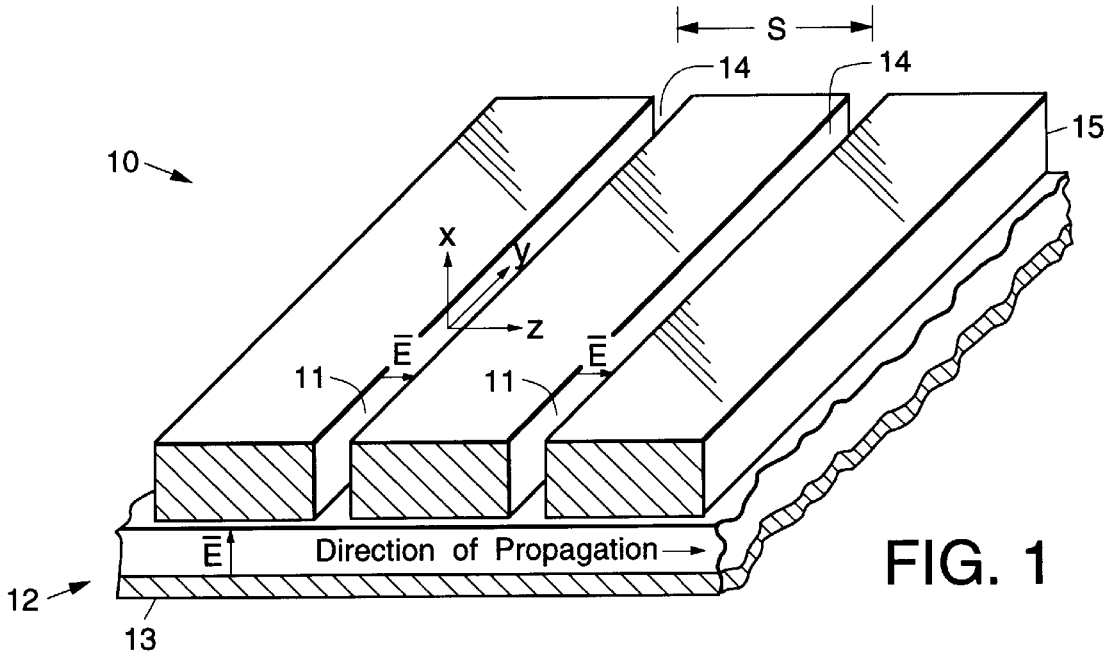
FIG. 1 illustrates an antenna radiating structure comprising a planar array of continuous transverse stub radiators having an integral parallel-plate waveguide feed.

Referring to the drawing figures, FIG. 1 illustrates an antenna radiating structure 10 comprises a planar array of air-filled continuous transverse stub radiators 11 coupled to an integral parallel-plate waveguide feed 12. A lower ground plane 13 is formed on a lower surface of the parallel-plate waveguide feed 12 of arbitrary dielectric composition opposite to the array of continuous transverse stub radiators 11. The array of continuous transverse stub radiators 11 are formed as transverse slots 14 formed in an upper ground plane 15. The array of continuous transverse stubs 11 are excited, as an example, by traveling or standing parallel-plate waveguide modes produced by the parallel-plate waveguide feed 12.

As TEM (or $TM_{m,0}$) waves propagate in the parallel-plate waveguide feed 12 along the +z direction (the direction of energy propagation), longitudinal electric currents in the upper ground plane 15 are interrupted by the presence of transverse stubs 11, continuous in the y direction (transverse to the direction of energy propagation). At the stub/parallel-plate waveguide interface, z-directed displacement currents are excited which in turn excite identical waveguide modes in the stubs 11 that travel in the +x direction to the end, where they are either reflected or radiated into free space. An alternative geometry for feeding the planar radiating structure is using direct true time delay feeding as described in copending U.S. patent application Ser. No. 08/884,952 filed Jun. 30, 1997, entitled "Compact, Ultra-Wideband, Antenna Feed Architecture Comprising a Multistage/Multilevel Network of Constant Reflection-Coefficient Components", assigned to the assignee of the present invention, and internally identified as PD-970046. The contents of this application are incorporated herein by reference in its entirety.

Figure 2A:
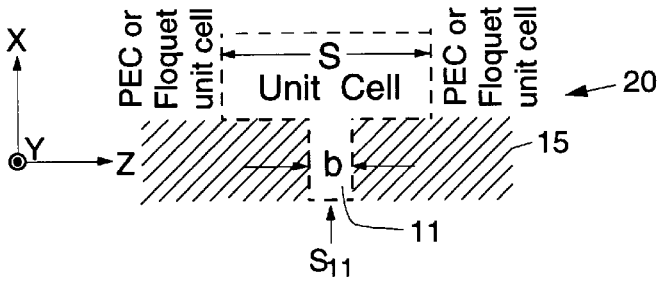
FIG. 2*a* illustrates unit cell of an infinite array of continuous transverse stub radiators.
Figure 2B:
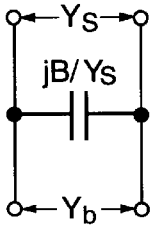
FIG. 2*b* illustrates an equivalent circuit for the unit cell of FIG. 2*a;*

The array of stubs 11 has uniform cross section in the y direction (i.e., in the plane of the upper ground plane 15) and is assumed to be infinite in the z direction (the direction of energy propagation). Therefore, the radiating structure 10 may be analyzed using a unit cell 20 shown in FIG. 2*a*. As shown in FIG. 2*a*, the width of the stub 11 in the z direction is designated "b", while the element-to-element spacing between stubs 11 is designated "S". For broadside operation, lateral boundaries of the unit cell 20 are considered to be perfect electric conductors (PEC). Alternatively, for non-broadside operation (E-plane scan), the lateral boundaries are treated as Floquet unit cell boundaries. The symmetrical change in height of two waveguides (i.e., from "b" of the stub to "S" of free space bounded by the perfect electric conductors) may be represented by the equivalent circuit shown in FIG. 2*b*. This equivalent circuit is discussed in Montgomery, C. G., R. H. Dicke and E. M. Purcell (eds.), "Principles of Microwave Circuits" (MIT Radiation Lab. Ser. No. 8), pg. 188, McGraw-Hill, New York, 1951, for example.

Figure 3A:
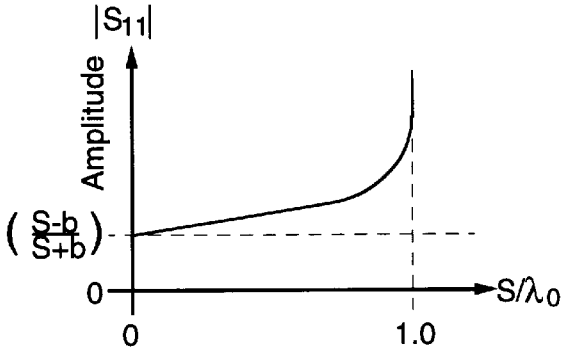
FIG. 3*a* illustrates the reflection coefficient of the junction reactance versus $S/\lambda_0$.
Figure 3B:
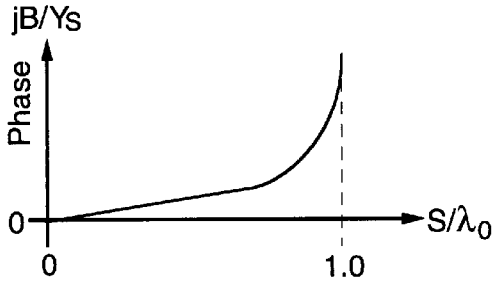
FIG. 3*b* illustrates the phase slope of the junction reactance versus $S/\lambda_0$.

FIGS. 3*a* and 3*b* illustrates that the choice of S determines the amplitude of the reflection coefficient and phase slope of the junction susceptance. FIGS. 3*a* and 3*b* show qualitatively how the choice of element-to-element spacing "S" affects the amplitude of the reflection coefficient and phase slope of the junction susceptance. While operation near $S/\lambda_0=1$ should be avoided (due to higher-order modes in the z dimension), it is not practical to choose $S<<\lambda_0$. The present invention mitigates the problem adding an intermediate matching step 21 (FIG. 4*a*) between the stub 11 and free space, thereby matching (by cancellation) both the real and imaginary components of the complex reflection coefficient over a wide range of frequencies. Similarly, an arbitrary number of intermediate stages may be implemented in order to generally realize any desired impedance characteristic with respect to frequency and/or scan angle.

FIGS. 4*a* and 4*b* illustrate a unit cell 20*a* and equivalent circuit of a matched continuous transverse stub radiator 11. FIG. 4*a* shows the unit cell 20*a* with a intermediate matching step 21, while FIG. 4*b* shows its equivalent circuit, consisting of the junction susceptance jB/Ys and the susceptance jB/Ys of the compensating matching step 21.

FIGS. 5*a* and 5*b* illustrate beam scanning in the H-plane using the continuous transverse stub radiator 11. FIGS. 5*a* and 5*b* show side and end views, respectively, of the continuous transverse stub radiator 11 and illustrate beam scanning provided thereby. The continuous transverse stub radiator 11 also offers some advantages for wide-angle beam scanning in the H-plane (i.e., the y direction) due to the continuous nature of its geometry.

If the wave traveling in the parallel-plate waveguide feed 12 is canted with respect to the y direction of the continuous transverse stub radiator 11, then the beam will be scanned in the y direction as shown in FIG. 5*a*. If the continuous transverse stub radiator 11 is comprised of dielectric medium $\epsilon_i>1$ and radiates into free space, where $\epsilon_0=1$, then the following relationships apply:

$$Z_b=Z_{bd}\mathrm{Sec}\theta_i \tag{1}$$

$$Z_S=Z_{S0}\mathrm{Sec}\theta_0, \tag{2}$$

$$(\epsilon_0)^{1/2}\mathrm{Sin}\theta_0=(\epsilon_i)^{1/2}\mathrm{Sin}(\theta_i)] \tag{3}$$

Dividing Equation (1) by Equation (2) yields:

$$Z_bZ_S=Z_{b1}/Z_{S0}[(1-\epsilon_i/\epsilon_0)\mathrm{Sin}^2\theta_i)/(1-\mathrm{Sin}^2\theta_i)]^{1/2} \tag{4}$$

Equation (4) shows that for the special case of $\epsilon_i=\epsilon_0$, the impedance ratio of stub to free space is independent of scan angle.

E-plane scanning is treated by assuming that the array geometry is infinite in both the y and z directions. This allows Floquet's Theorem to be used, and it is only necessary to consider the field within the unit cell 20. The perfect electric conductor walls are replaced with periodic boundary conditions (Floquet unit cell boundaries). The complex reflection coefficient at the aperture, which is a function of frequency, E-plane scan angle, H-plane scan angle and the geometry of the array of continuous transverse stub radiators 11, may then be readily computed using a modal matching technique and is also found to be well-behaved with respect to both frequency and scan angle due to the strong and constant mutual coupling between the stub radiators 11.

In the case of multiple intermediate stages, the previously described equations and susceptance terms, and/or Floquet's theorem, may be employed to compute the scan-dependent characteristic impedance $Z_n$ and scan angle $\theta_n$ for each stage, whereby conventional circuit analysis may be employed to predict both the frequency and scan-dependence of the ensemble radiating structure.

Referring now to FIG. 6, it illustrates an antenna radiating structure 30 in accordance with the principles of the present invention. The antenna radiating structure 30 comprises a planar array of continuous transverse stub radiators 11*a* coupled to a parallel-plate waveguide feed 12. A lower ground plane 13 is formed on a lower surface of the parallel-plate waveguide feed 12 opposite to the array of continuous transverse stub radiators 11*a*. The array of continuous transverse stub radiators 11*a* are formed as stepped transverse slots 14*a* formed in an upper ground plane 15. The stepped transverse slots 14*a* comprise a lower relatively narrow slot 22*a* disposed adjacent to the parallel-plate waveguide feed 12 and an upper relatively wide slot 22*b* disposed adjacent to a radiating aperture (i.e., distal from the lower ground plane 13) of the antenna radiating structure 30. The array of continuous transverse stubs 11*a* are excited, as an example, by traveling or standing parallel-plate waveguide modes produced by the parallel-plate waveguide feed 12.

Referring now to FIG. 7, it illustrates an alternative feed structure 40 which may be used to feed the present (radiator) invention in a true-time-delay structure. More specifically, FIG. 7 shows an embodiment of a true-time-delay ultra-wideband corporate feed architecture 40 comprising an eight-way, true-time-delay corporate feed 40 fabricated using a low-loss microwave dielectric such as Rexolite®. Dielectric components are bonded together, then the surfaces are metalized with an RF conductor such as silver or aluminum, to form a parallel-plate waveguide feed structure. Three levels (level 1, level 2, level 3) of the corporate feed architecture 10 are shown in FIG. 7. This feed structure 40 is described in detail in the above identified copending patent application entitled "Compact, Ultra-Wideband, Antenna Feed Architecture Comprising a Multistage/Multilevel Network of Constant Reflection-Coefficient Components".

Thus, an improved planar antenna radiating structure having a quasi-scan, frequency-independent driving-point impedance has been disclosed. It is to be understood that the described embodiments are merely illustrative of some of the many specific embodiments which represent applications of the principles of the present invention. Clearly, numerous and other arrangements can be readily devised by those skilled in the art without departing from the scope of the invention.

What is claimed is:

1. A planar antenna radiating structure having a quasi-scan, frequency-independent driving-point impedance, said structure comprising:

a parallel-plate waveguide feed comprising a lower ground plane formed on a lower surface thereof; and a planar array of continuous transverse stub radiators comprising a plurality of transverse stepped slots formed in an upper ground plane formed on an upper surface of the parallel-plate waveguide feed, and wherein each of the stepped slots comprises a lower relatively narrow slot disposed adjacent to the parallel-plate waveguide feed and an upper relatively wide slot distally disposed from the lower ground plane.

2. The structure of claim 1 wherein a plurality of sequential stages effectively cancel the susceptance of the radiating structure and provides for a predetermined arbitrary, substantially real, reflection coefficient over a wide range of operating frequencies for the radiating structure.

3. The structure of claim 1 wherein the array of continuous transverse stubs are excited by traveling waveguide modes generated by the parallel-plate waveguide feed.

4. The structure of claim 1 wherein the array of continuous transverse stubs are excited by standing parallel-plate waveguide modes generated by the parallel-plate waveguide feed.

5. The structure of claim 1 wherein the array of continuous transverse stubs are excited by a direct true-time-delay corporate feed.

* * * * *